US008464406B2

(12) United States Patent
Anscher

(10) Patent No.: US 8,464,406 B2
(45) Date of Patent: Jun. 18, 2013

(54) QUICK RELEASE BUCKLE ASSEMBLY

(75) Inventor: Joseph Anscher, Muttontown, NY (US)

(73) Assignee: National Molding-Duraflex, LLC, Miami Lakes, FL (US)

( * ) Notice: Subject to any disclaimer, the term of this patent is extended or adjusted under 35 U.S.C. 154(b) by 444 days.

(21) Appl. No.: 12/798,622

(22) Filed: Apr. 8, 2010

(65) Prior Publication Data

US 2011/0247182 A1 Oct. 13, 2011

(51) Int. Cl.
*A44B 11/25* (2006.01)

(52) U.S. Cl.
USPC ..... 24/615; 24/163 R; 24/625; 24/647; 24/665

(58) Field of Classification Search
None
See application file for complete search history.

(56) References Cited

U.S. PATENT DOCUMENTS

| | | | | |
|---|---|---|---|---|
| 5,832,573 | A | 11/1998 | Howell | |
| 6,154,936 | A | 12/2000 | Howell et al. | |
| 6,175,304 | B1 * | 1/2001 | Becker | 340/457.1 |
| 6,487,761 | B2 | 12/2002 | Van Tassel | |
| 7,828,180 | B2 * | 11/2010 | Slesar | 224/257 |
| 2006/0123607 | A1 | 6/2006 | Howell | |
| 2007/0220719 | A1 * | 9/2007 | Shen | 24/652 |

* cited by examiner

*Primary Examiner* — Jack W. Lavinder
(74) *Attorney, Agent, or Firm* — Collard & Roe, P.C.

(57) ABSTRACT

A quick release buckle assembly has a male portion that is inserted into a female portion. Each female portion has a cavity and at a spring-loaded locking device disposed within the cavity. Each male portion has a base with a locking tongue having an aperture, such that inserting the male portion into the open top of the female portion causes the locking device to snap into the aperture in the locking tongue to lock the two buckle portions together. To release the buckle portions, the locking device is pulled upward, in a direction that is between 45 to 90 degrees to the insertion plane of the female portion, until the locking device clears the aperture in the locking tongue. The motion required to release the male portion from the female portion ensures that the buckle will not be inadvertently released by catching on something in the environment.

8 Claims, 4 Drawing Sheets

QUICK RELEASE BUCKLE ASSEMBLY

BACKGROUND OF THE INVENTION

1. Field of the Invention

This invention relates to a quick-release buckle system. In particular, the invention relates to a quick-release buckle system that can be used on articles that need to be quickly and easily removed by the user.

2. The Prior Art

Standard two-part buckle systems usually require the user to squeeze two legs of the male buckle portion in order to release the male portion from the female portion. However, this often cannot be easily done if the buckle is to be disengaged while the user is moving. There have been several attempts to devise a buckle assembly that can be unlocked very quickly and easily, even when the user is moving.

U.S. Pat. No. 6,487,761 to Van Tassel, the disclosure of which is herein incorporated by reference, shows a buckle assembly that can be disengaged by pulling on a cord connected to the male buckle portion. The cord is connected to the legs of the male portion, so that pulling on the cord forces the male legs toward each other and out of the locking slots of the female portion. While this buckle device allows for quick release, there are situations where a the direction of the cord pull might cause inadvertent release of the buckle. For example, on a shoulder harness for a backpack worn by the military and law enforcement, the cord pull might catch on roots or rocks while the wearer is crawling on the ground. It is desirable to develop a buckle that can be easily released in restricted environments, and which will not become released inadvertently.

In addition, in the buckle disclosed in U.S. Pat. No. 6,487,761, the force required to release the buckle is dependent on the stiffness of the locking legs of the male portion. In making the locking legs stronger, they become stiffer, and a great amount of force is required to release the buckle. However, if the legs are made more flexible, they are also more prone to breakage. It would be desirable to develop a buckle in which the strength of the locking mechanism is independent of the force required to release the buckle.

SUMMARY OF THE INVENTION

It is therefore an object of the invention to provide a quick-release buckle system that can be used on articles of that need to be quickly unlocked, and which cannot be inadvertently disengaged.

This and other objects are achieved by a quick release buckle assembly having a male portion that is inserted into a female portion. Each female portion comprises a hollow body with a front wall, a back wall, an open top, a cavity between the front and back walls and a spring-loaded locking device disposed within the cavity. Each male portion comprises a base with a locking tongue, such that inserting the male portion into the open top of the female portion causes the locking device to engage the locking tongue to lock the two buckle portions together. To release the buckle portions, the locking device is pulled upward, in a direction perpendicular to the plane of the buckle portions and the locking tongue, until the locking device clears the locking tongue by sliding out of engagement with the locking tongue. At this point, the locking device pushes the male portion out of the female portion. The sliding motion required to release the male portion from the female portion ensures that the buckle will not be inadvertently released by catching on something in the environment. The buckle is easily released by pulling upward on the locking device, but is secure in all environments. As opposed to buckles requiring a lateral movement or a pivoting motion of a lever, such as in conventional seat belt operations, the purely sliding motion required by the present invention cannot occur inadvertently. To facilitate release of the buckle by the user, the locking device can be attached to a cord or a strap. This allows the user to easily locate and release the buckle when needed.

The buckle can be released by pulling on the locking device in a pre-set angle to the insertion plane of the male and female buckle portions. This angle could be anywhere between 45 and 90 degrees to the insertion plane of the buckle. This prevents inadvertent disengagement, because the only way to release the buckle is to pull directly in the pre-set angle. Pivoting or lateral pulling motions will not release the buckle.

In a preferred embodiment, the locking device comprises a catch that is connected via springs to the female buckle portion. In a resting position, the locking device is positioned so as to lock the male portion in, with the catch extending through an aperture in the male portion when the male portion is inserted. The locking device has an upper section that is accessible from the top of the female portion. This upper section allows a strap or cord to be attached to the locking device. The locking device is disposed to be slidable within the female portion in a pre-set direction, either perpendicular to the insertion plane of the buckle, or at an angle of up to 45 degrees from perpendicular. Pulling on the strap or cord in the sliding direction of the locking device flexes the springs and moves the locking device upward and out of the aperture in the male portion to release the male portion. Pulling on the cord in anything but the pre-set direction of the locking device does not exert enough force to remove the locking device from the aperture, and thus it cannot be disengaged, even if the cord catches on another object during use.

In an alternative embodiment, the male portion could have a catch on the locking tongue that interacts with a corresponding catch or recess on the locking device to lock the male and female portions together. All that is required is that the locking tongue engage the locking device by pushing the male portion into the female portion, with the male portion being released by pulling on the locking device in the sliding direction of the locking device.

The locking device can also have an additional spring that contacts the end of the locking tongue when the male portion is locked to the female portion. This additional spring presses against the tip of the locking tongue, and pushes the locking tongue out of the female portion as soon as the aperture is released from the locking device.

The springs are preferably integrally molded with the locking mechanism and are biased against internal walls of the female portion to keep the locking mechanism in a resting position. The springs also serve to keep the locking mechanism securely within the female portion; it cannot become separated from the female portion. In one embodiment, the springs extends from the locking mechanism and rest against the interior of the top surface of the female portion.

The bottom of the locking mechanism is preferably slanted downward toward a rear of the female portion so that the locking tongue on the male portion can slide easily along the bottom of the locking mechanism until the locking mechanism comes to rest inside the aperture in the locking tongue.

In a preferred embodiment, the locking tongue has guide flanges along its side edges, which slide into guide slots in the female portion, to ensure that the male portion is inserted properly.

The male portion can have means on the base for attaching an object to the male portion. In one embodiment, this means is a plate extending from the base. There is an aperture extending through the plate for attachment of various devices. Other attachment means can also be used, such as bars for securing straps. Any suitable attachment mechanism can be used.

The present invention is ideal for use in locations when only a small quick movement is require to unlock the buckle. With the present invention, all that is required is for the locking mechanism to be pulled upward in the sliding direction of the locking device. The buckle cannot be unlocked by pulling laterally on the locking device or by a pivoting motions, so that even if a strap that is attached to the locking mechanism becomes caught on a branch or rock, the buckle will not become unlocked. Lateral force on the locking mechanism has no effect on the release action of the buckle.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE EMBODIMENTS

Figure 1:
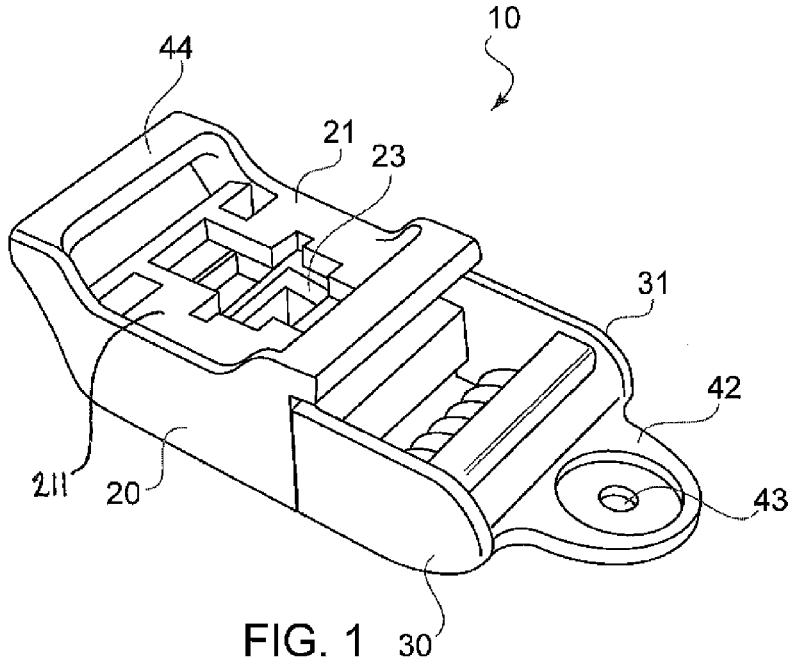
FIG. 1 shows a bottom perspective view of the buckle assembly according to one embodiment of the invention.
Figure 2:
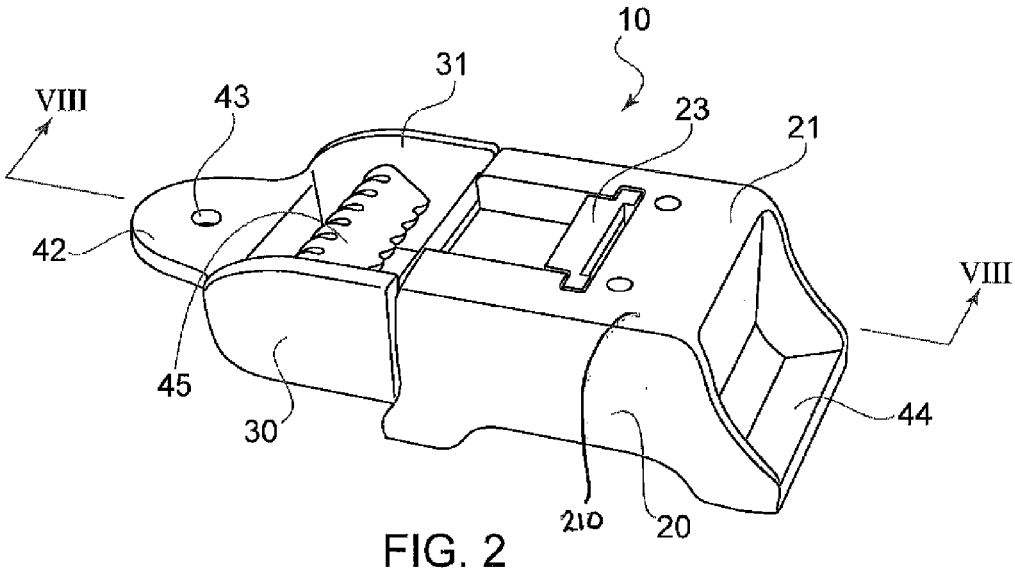
FIG. 2 shows a top perspective view of the embodiment of FIG. 1.
Figure 3:
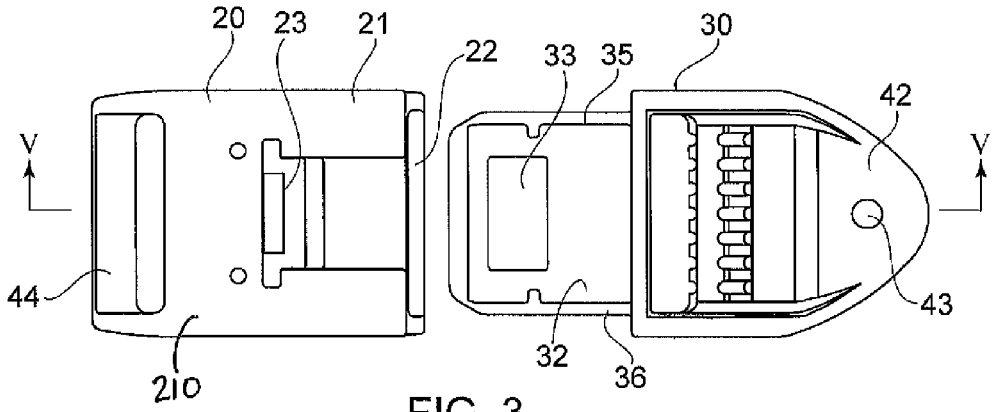
FIG. 3 shows of top view of the buckle assembly in an unassembled state.
Figure 4:
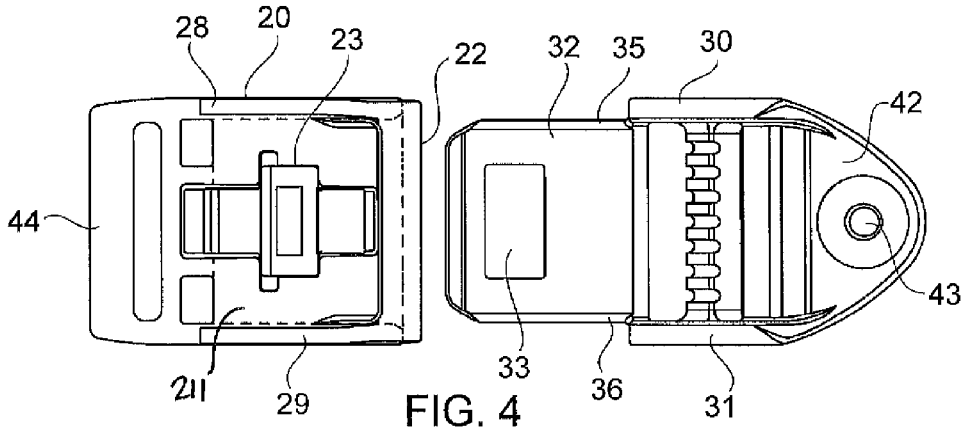
FIG. 4 shows a bottom view of the buckle assembly in an unassembled state.
Figure 5:
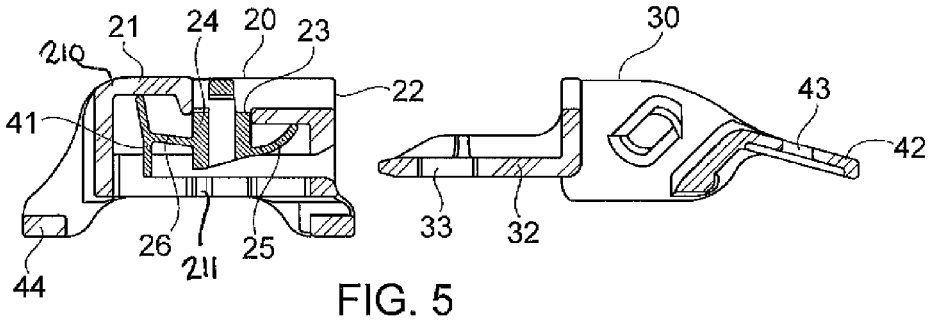
FIG. 5 shows a side cross-sectional view along lines V-V of FIG. 3.
Figure 6:
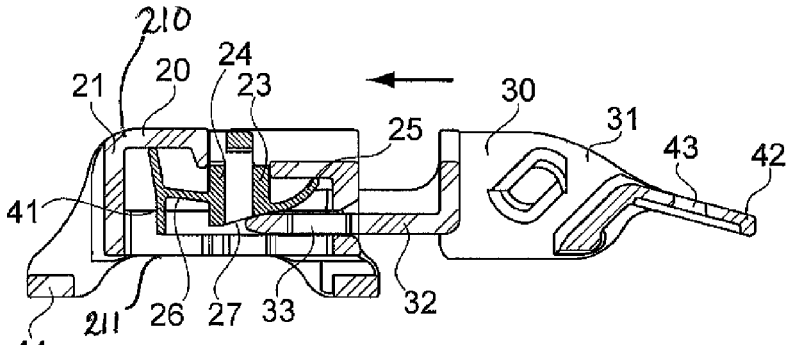
FIG. 6 shows a cross-sectional view as the male portion is inserted into the female portion.

Turning to the drawings, FIGS. 1-4 show a buckle assembly 10 according to one embodiment of the invention. Buckle assembly 10 consists of a female portion 20 and a male portion 30. Female portion 20 comprises a hollow main body 21 with a planar front and back surfaces 210, 211, respectively, an open top 22 communicating with the interior of the hollow main body 21, and a locking device 23 disposed within the cavity. Male portion 30 has a base 31 and a locking tongue 32 connected to base 31. Locking tongue 32 has an aperture 33.

Locking device 23 comprises a catch 24 that is connected to springs 25, 26 which retain locking device 23 inside the cavity of female buckle portion 20. Locking device 23 is a separate piece from female portion 30 and is slidably disposed within female portion 30. Springs 25, 26 press against the underside of the top of main body 21 to keep catch 24 in a loaded, locked state unless sufficient upward pressure is exerted on locking device 23 to pull it out of its resting position. Springs 25, 26 are integrally molded with catch 24.

Figure 7:
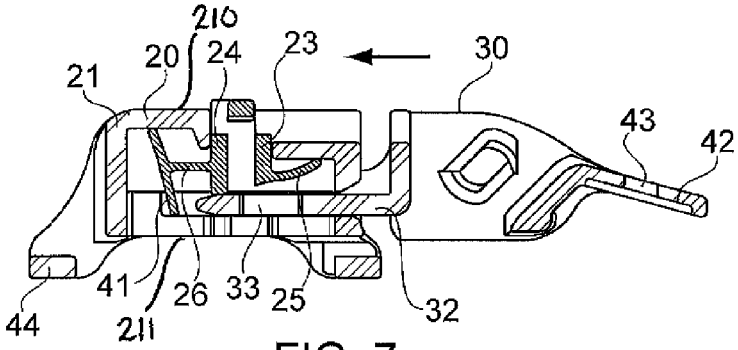
FIG. 7 shows a cross-sectional view as the male portion is inserted farther into the female portion.
Figure 8:
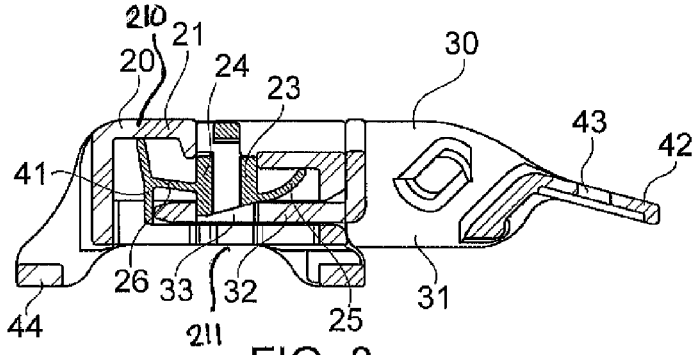
FIG. 8 shows a cross-sectional view of the buckle assembly in a fully inserted state, along lines VIII-VIII of FIG. 2.

FIGS. 5-8 show the progressive insertion of male buckle portion 30 into female buckle portion 20, in a direction parallel to the insertion plane of the male and female buckle portions. Inserting male portion 30 into open top 22 of female portion 20 in the direction of the arrow, i.e., along the insertion plane of the male and female buckle portions, causes the catch 24 to snap into aperture 33 in locking tongue 22 to lock the two buckle portions together. During insertion, locking tongue 32 slides along the bottom of catch 24 and pushes against it, causing catch 24 to rise up slightly, as shown in FIG. 7. Once locking tongue 32 has been fully inserted into female portion 30, aperture 33 of locking tongue 32 is lined up with catch 24, and the pressure of springs 25, 26 causes catch 24 to snap into aperture 33 to lock male buckle portion 30 to female buckle portion 20, as shown in FIG. 8. Catch 24 has a lower edge 27 (shown in FIG. 7) that is slanted toward a rear of the female portion. This slanted lower edge 27 allows locking tongue 32 to slide easily along the bottom of catch 24 without becoming stuck. In an alternative embodiment (not shown), locking tongue 32 can have a catch instead of an aperture, which interacts with a corresponding device on locking device 23 to lock the male and female portions together.

Locking tongue 32 also has guide flanges 35, 36 along side edges of the locking tongue 32, and the female portion 30 has guide slots 28, 29 in its side walls, so that guide flanges 35, 36 slide into guide slots 28, 29 when the male portion 30 is inserted in the female portion 20.

Figure 9:
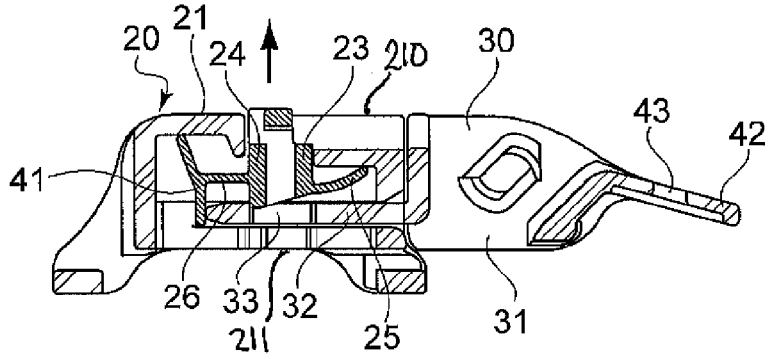
FIG. 9 shows a cross-sectional view of the male portion being released from the female portion.
Figure 10:
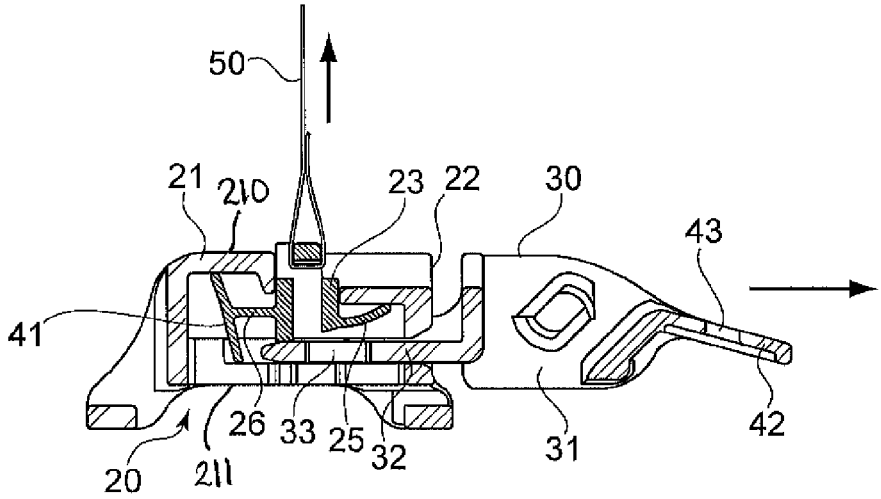
FIG. 10 shows a cross-sectional view of the male portion exiting the female portion after release.

As shown in FIGS. 9 and 10, buckle portions 20, 30 are released from each other by pulling locking device 23 upward in a direction perpendicular to a plane of female portion 20 (as shown by the upward arrow), until locking device 23 clears aperture 33 in locking tongue 32. To aid with the release of male portion 30 from female portion 20, a strap or cord 50 can be attached to locking device 23, as shown in FIG. 10. Instead of a perpendicular direction, the locking device could also be configured so that it slides in and out at an angle of anywhere between 45 and 90 degrees to the insertion plane of the buckles.

To assist with the removal of male portion 30 from female portion 20 during release of locking device 23, an additional spring 41 is connected to locking device 23. This additional spring presses against locking tongue 32 when male portion 30 is fully inserted into female portion 20, as shown in FIG. 8. Upon release of male portion 30, as shown in FIGS. 9 and 10, spring 41 pushes back against locking tongue 32 to force male portion 30 out of female portion 20 once locking mechanism 23 has been lifted enough to clear aperture 33 in locking tongue 32.

Male portion 30 has a plate 42 with an aperture 43 connected to base 31 for attaching an object to the male portion 30. Male portion 30 is also equipped with a strap retaining bar 45 for securing a strap. Female portion 20 also has a strap retaining bar 44 on an end thereof for securing a strap. Other attachment devices could also be used.

The present invention has advantages over other quick-release buckle assemblies in that it cannot be released by catching on another object. The buckle assembly according to the invention can only be released by pulling the locking device in the sliding direction of the locking device, which is between 45 and 90 degrees to the insertion plane of the buckle. The motion is a direct sliding motion, rather than a pivoting motion, as lever-type release systems can often be inadvertently disengaged by catching on objects in the environment.

Accordingly, while only a few embodiments of the present invention have been shown and described, it is obvious that many changes and modifications may be made thereunto without departing from the spirit and scope of the invention.

What is claimed is:

1. A quick-release buckle assembly, comprising:

a female portion comprising a hollow body with planar front and back surfaces, an interior cavity having internal walls, an open top communicating with the cavity, and a locking device slidably disposed within the cavity in a pre-set sliding direction, the locking device comprising a catch that is connected via springs to the female buckle portion; and a male portion comprising a base, and at least one locking tongue, wherein inserting the male portion into the open top of the female portion along an insertion plane of the female buckle portion causes the locking device to engage the locking tongue to lock the two buckle portions together, wherein the pre-set sliding direction is disposed at an angle of between 45 and 90 degrees to the insertion plane of the female portion and to the front and back planar surfaces of the female buckle portion, wherein the buckle portions are released from each other only by pulling the locking device in the sliding direction, until the locking device disengages from the locking tongue; and wherein the springs are integrally molded with the locking device and are biased against internal walls of the female portion to keep the locking device in a resting position.

2. The buckle assembly according to claim 1, wherein the locking device is attached to a cord or a strap.

3. The buckle assembly according to claim 1, wherein the springs bias the locking device such that in a resting position, the locking device is positioned so as to lock the male portion in, with the catch engaging the male portion when the male portion is inserted.

4. The buckle assembly according to claim 1, further comprising an additional spring connected to the female portion, said additional spring contacting an end of the locking tongue when the male portion is locked to the female portion, wherein said additional spring pushes the locking tongue out of the female portion during release of the male portion from the female portion.

5. The buckle assembly according to claim 1, wherein the springs extend from the locking device and rest against an interior surface of the female portion.

6. The buckle assembly according to claim 1, wherein the locking device has a bottom surface that is slanted downward toward a rear of the female portion, to aid insertion of the locking tongue into the female portion.

7. The buckle assembly according to claim 1, wherein the locking tongue has an aperture that engages the catch on the locking device.

8. The buckle assembly according to claim 1, wherein the sliding direction is 90 degrees to the insertion plane of the female buckle portion.

* * * * *